United States Patent [19]

Black et al.

[11] Patent Number: 4,998,524

[45] Date of Patent: Mar. 12, 1991

[54] MANIFOLD MOUNTED AIR PUMP

[75] Inventors: Gregg T. Black, Livonia; Joseph F. Goulart, Union Lake, both of Mich.

[73] Assignee: Chrysler Corporation, Highland Park, Mich.

[21] Appl. No.: 351,989

[22] Filed: May 15, 1989

[51] Int. Cl.[5] ..... F02B 33/00

[52] U.S. Cl. ..... 123/559.1

[58] Field of Search ..... 123/559.1, 65 BA

[56] References Cited

U.S. PATENT DOCUMENTS

| | | | |
|---|---|---|---|
| 2,099,785 | 11/1937 | Willgoos | 123/559.1 |
| 2,196,071 | 4/1940 | Hudson | 123/559.1 |
| 2,236,634 | 4/1941 | Yamashita | 123/559.1 |
| 2,745,392 | 5/1956 | Nallinger | 123/559.1 |
| 2,851,024 | 4/1956 | Meeder . | |
| 3,568,650 | 3/1971 | Albrich | 123/559.1 |
| 3,832,089 | 8/1974 | Moellmann . | |
| 4,693,669 | 9/1987 | Rogers, Sr. . | |

*Primary Examiner*—Douglas Hart

*Attorney, Agent, or Firm*—Kenneth H. MacLean, Jr.

[57] ABSTRACT

In association with an internal combustion engine having an intake manifold with an inlet opening at one end, an air pump of the type including an impeller on a rotatable shaft and a discharge opening, with the air pump mounted directly to the manifold so that the manifold's inlet opening and the pump's discharge opening are registered thereby allowing air to flow from the pump directly into the manifold interior.

1 Claim, 1 Drawing Sheet

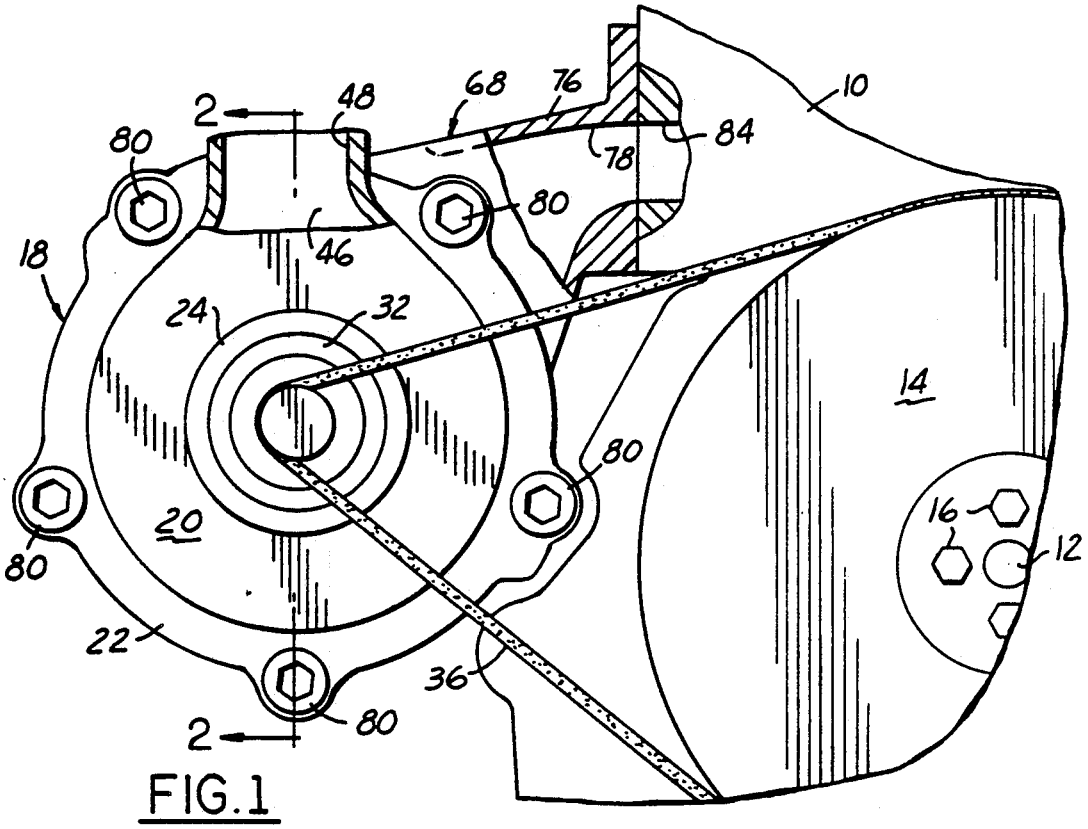
FIG.1
FIG.2
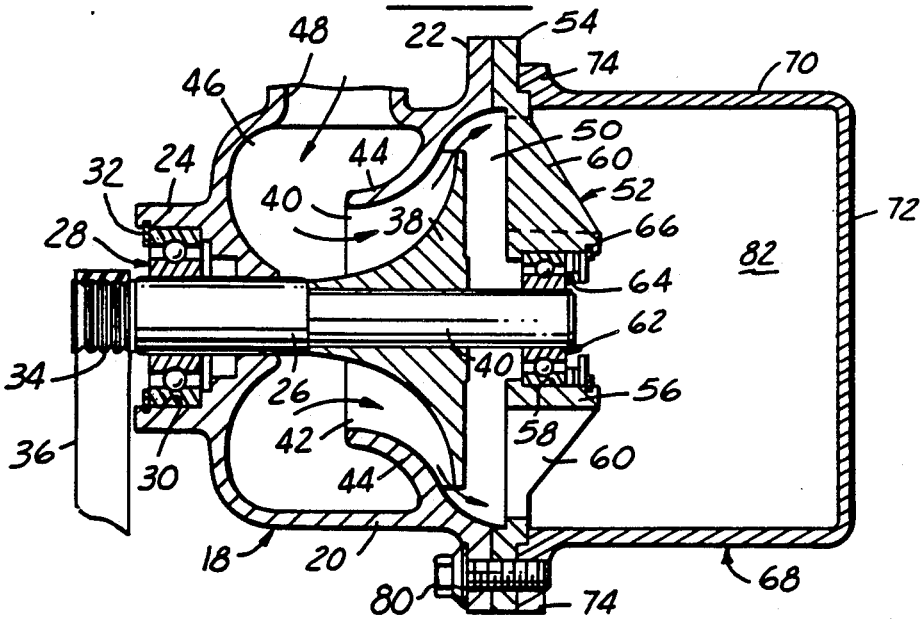

MANIFOLD MOUNTED AIR PUMP

BACKGROUND OF THE INVENTION

The use of an air pump to increase the efficiency of an internal combustion engine is known. These pumps discharge air into the combustion chamber as opposed to the more common technic of allowing the engine or piston dynamics suck air therein. It is also known to drive such an air pump by the crankshaft of the engine through a belt or the like. Many prior air pumps have been located in an engine compartment so as to undesirably increase engine size. Other prior arrangements locate the air pump remotely from the engine induction system which necessitates a bulky and costly air distribution tube or the like.

A typical type of air pump utilizes a compressor wheel with vanes thereon. Air is introduced to the wheel's central portion in the axial direction. Air is directed from the peripheral edge of the wheel in a radial direction. The pump discharge air is typically collected in a scroll shaped housing or the like. This arrangement is bulky at least in the radial direction and generally does not easily fit within the confines of modern engine compartments. Examples of this arrangement are disclosed in U.S. Pat. No. 3,832,089 to Moellmann and U.S. Pat. No. 2,851,024 to Meeder.

Resultantly, desirable characteristics of engine air pumps include compactness and the capability to mount the air pump in a cramped engine compartment. To a limited extent, an air pump like this is disclosed in U.S. Pat. No. 4,693,669 to Rogers. A radial impeller is disclosed therein and air is directed radially outward and then rearwardly into a collector housing. The air flow is subsequently directed through tubing to the engine intake.

SUMMARY OF THE INVENTION

The subject engine air pump has a radial flow type impeller which is mounted for rotation within a generally hollow housing. The impeller is affixed to a shaft which is driven by the engine's crank shaft through means of a belt drive. The pump housing has an outlet adjacent the peripheral edge of the impeller to accept air from the pump impeller. The pump housing is directly mounted on an open end of the engine's intake manifold.

A distinguishing feature of this embodiment is the integration of the pump directly with the intake manifold of the engine, thus eliminating any time lag between pumping of air and receipt of air by the manifold. Also, this arrangement eliminates tubing or ducting for air distribution. The advantages of this arrangement are compactness, simplicity and cost effectiveness. Also, the resultant structure eliminates accessory devices such as mounting brackets for the pump. Therefore, weight savings are possible.

Accordingly, a major advantageous feature of the subject engine with an air pump is compactness as well as simplicity directly resulting from the integration of the air pump and the engine manifold as a single unit.

Other advantageous features of the subject intake manifold mounted air pump will be more readily apparent from a reading of the following detailed description, reference being had to the accompanying drawings in which a preferred embodiment is illustrated.

IN THE DRAWINGS

FIG. 1 is a elevational view of a part of the forward end of an internal combustion engine including an associated air pump; and FIG. 2 is a sectioned view of the air pump and part of the engine manifold taken along section line 2—2 in FIG. 1 and looking in the direction of the arrows.

DESCRIPTION OF A PREFERRED EMBODIMENT

In FIG. 1, a view of part of the forward end portion of an internal combustion engine block is illustrated. This includes a view of part of the engine block 10 which supports a rotatable crankshaft. Only the exposed end portion 12 of the crankshaft is visible in FIG. 1. A relatively large diameter belt drive member or pulley 14 is attached to the crankshaft end 12 by means of a plurality of fasteners 16.

An air pump 18 is located to the left of the crankshaft 12 in FIG. 1 and has a generally hollow housing 20 best detailed in FIG. 2. Housing 20 has a radially outwardly turned peripheral edge portion 22 and a central portion 24. A rotatable shaft 26 extends through housing 18 and specifically through central portion 24. Shaft 26 is supported for rotation at a leftward end by a bearing assembly 28. The bearing is mounted in a cylindrical recess 30 and is retained therein by a radially expandable retainer member 32 which engages a groove in central portion 24. The leftward end of shaft 26 in FIG. 2 has a series of V-shaped grooves 34 adapted to be engaged by similarly configurations of an endless drive belt 36. The belt 36 also wraps around the perimeter of large diameter pulley 14. Accordingly, the rotation of crankshaft 12 and pulley 14 drives air pump shaft 26 by means of belt 36. Since pulley 14 is relatively large with respect to the diameter of shaft 26, shaft 26 is rotated at a much greater speed than crankshaft 12.

A multi-vaned radial type impeller 38 is attached to the midportion of shaft 26. The impeller is mounted on a reduced diameter portion 40 of shaft 26. In FIG. 2, only two of the impeller's vanes 40 and 42 are visible. Obviously, the impeller 38 has many other circumferentially spaced vanes as is common in the pump art. In addition, pump housing 20 includes an interior wall means 44 which lies adjacent the edge of the impeller's vanes to form an air passage between the vanes.

In the illustrated embodiment, air enters an interior 46 of housing 20 upstream of the impeller through inlet 48. In an operative engine environment, the inlet 48 is connected to an air source which likely includes an air cleaner as is commonly done in the engine art.

As shown in FIG. 2, the outwardly extending flange portion 22 of housing 20 encircles an annular space 50 just outward from the impeller's peripheral edge. Air flows through and from the impeller are represented by the arrows in FIG. 2. Air is discharged from the impeller into an annular space 50 and then flows rightward in an axial direction with respect to the impeller 38.

The air pump also supports the rightward end portion of the shaft 26 by means of a bridge member 52. Member 52 has an outwardly extending peripheral edge portion 54 overlying the edge portion 22 of housing 20. Member 52 also has a central portion 56 which defines a cylindrical bore 58 through which the shaft 26 extends. The peripheral edge portion 54 and the central portion 56 are connected by a plurality of relatively thin vanes or legs 60. In the illustrated preferred embodiment, there are three vanes 60 provided. The bore 58 accepts a bearing assembly 62 which actually engages the rightward end of shaft 26 and supports it for rotation. A thrust bearing assembly 64 is associated with the bearing assembly 62 for the purpose of axially fixing the position of shaft 26. Radially expandable retainer 66 secures the bearings 62 and 64 in the cylindrical bore 58. It is contemplated that the bridge member may not be a distinct piece but may be an integral part of the manifold structure itself. Also, the housing 20 could also be designed to be an integral part of the manifold rather than an attached portion thereof.

As previously stated, the air pump 18 is attached across the open end of manifold 68 formed by a thin-walled housing 70 with an opposite closed end portion 72. The open end is encircled by outwardly directed flange portion 74. The manifold 68 has several individual air distributing runners 76, one for each cylinder (only one of which is visible in FIG. 1). The peripheral flange 74 overlies the peripheral edge 54 of the bearing support bridge assembly 52. Portions 22, 54 and 74 are secured together by the plurality of fasteners 80.

By this arrangement, air enters the pump through inlet 48 and passes between the impeller vanes into the space 50. Air then flows axially past legs 60 directly into the manifold interior 82.

By means of the above described and illustrated embodiment, a simple and compact engine air pump is provided. The need for air distributing tubing or the like to direct the flow of air from the pump into the engine is unnecessary.

Although only a single embodiment of the invention is shown in the drawings and described in detail, it should be clear that many modifications may be made thereto without falling outside the scope of the following claims which define the invention. Specifically, it is contemplated that the design details of the pump and manifold may vary as long as the essential feature of an integral pump and manifold housing structure is maintained.

What is claimed:

1. The combination of: an internal combustion engine having an elongated intake manifold with an open ended portion acting as an air inlet to receive air flow into the engine; an air pump with a housing supported at the open end of the intake manifold, the pump housing having an open ended portion acting as an air outlet from the pump, the open ended portions of the pump and the manifold being sized and configured so that the air outlet of the pump and the air inlet of the manifold are axially aligned when the open ended portion of the pump is attached to the open ended portion of the manifold, whereby air flows substantially in an axial direction from the pump into the manifold; the pump housing having a generally hollow interior and a substantially closed end portion opposite the open ended portion; and elongated shaft extending axially through the interior of the pump housing with a first end portion extending through the closed end portion so that an exterior end portion to the pump housing is exposed, an opposite second end portion of the shaft extending axially through the pump housing and into the open ended portion of the manifold; an impeller attached to the shaft between its first and second end portions with the pump housing encircling the impeller so that air may flow past the impeller from the vicinity of the first end portion of the shaft to the vicinity of the second end portion of the shaft; rotative input means coactive with the exterior end portion of the shaft for causing rotation of the shaft and impeller whereby air is pumped into the intake manifold; a shaft supporting assembly for the second end portion of the shaft, the assembly including a peripheral annulus-like edge portion secured between those end portions of the pump housing and the manifold which respectively define the air outlet and the air inlet, the assembly further including a central shaft engaging bearing portion attached to the peripheral edge portion by a plurality of thin bridge portions; the bridge portions being configured so that at least a substantial portion of the central shaft engaging bearing portions is positioned within the manifold whereby the axial length of the combination pump and manifold is shortened.

* * * * *